United States Patent [19]

Minnebraker

[11] 4,428,594

[45] Jan. 31, 1984

[54] WHEEL ASSEMBLIES FOR USE WITH WHEELCHAIRS

[75] Inventor: Jeffrey P. Minnebraker, Westlake Village, Calif.

[73] Assignee: Quadra Wheelchairs, Inc., Westlake Village, Calif.

[21] Appl. No.: 381,008

[22] Filed: May 24, 1982

Related U.S. Application Data

[63] Continuation-in-part of Ser. No. 206,346, Nov. 13, 1980, Pat. No. 4,351,540.

[51] Int. Cl.[3] ..... A61G 5/04

[52] U.S. Cl. ..... 280/242 WC; 16/30; 297/DIG. 4

[58] Field of Search ..... 280/242 WC; 297/DIG. 4; 180/DIG. 3; 16/30, 43, 39, 38, 35 D, 18 A

[56] References Cited

U.S. PATENT DOCUMENTS 2,729,272 1/1956 Lidge et al. ..... 297/DIG. 4

3,217,478 11/1965 De Geere ..... 280/47.32

4,166,631 9/1979 Sanaski ..... 280/242 WC 4,362,311 12/1982 Bergman ..... 280/242 WC

FOREIGN PATENT DOCUMENTS 489278 12/1952 Canada ..... 16/35 D

*Primary Examiner*—John A. Pekar

*Attorney, Agent, or Firm*—Robert J. Schaap

[57] ABSTRACT

Front wheel assemblies for use with wheelchairs of the type having a main frame and large diameter rear wheels and a seat structure thereon. The front wheel assemblies are highly effective in that they permit a quick release of the front wheel for easy and quick removal of the front wheel and easy and quick replacement of a front wheel. The front wheel assemblies are designed so that the trailing angle of the front wheel relative to the ground or supporting surface can be varied and further, a locking mechanism is provided for temporarily locking the front wheels in a selected position.

45 Claims, 12 Drawing Figures

WHEEL ASSEMBLIES FOR USE WITH WHEELCHAIRS

RELATED APPLICATION

This application is a continuation-in-part of my copending application Ser. No. 206,346, filed Nov. 13, 1980 entitled "Wheelchair Construction", now U.S. Pat. No. 4,351,540.

BACKGROUND OF THE INVENTION

1. Field of the Invention

This invention relates in general to certain new and useful improvements in wheelchairs, and more particularly, to improved front wheel assemblies used on wheelchairs.

2. Brief Description of the Prior Art

Wheelchair constructions have remained unchanged, except for relatively minor features, for a substantial period of time. While wheelchairs have existed for many years, they generally were constructed of a main frame, front and rear wheels, side rails or so-called "arm rests" and foot support members.

In recent years, it has been found to be highly beneficial for paraplegics and others required to use wheelchairs on a relatively permanent basis to engage in various forms of athletic activities, including wheelchair racing, tennis, and the like. However, the wheelchair constructions heretofore did not lend themselves to such forms of activities. This was primarily due to the large box-like construction with the high center of gravity in essentially all prior art wheelchairs.

There has been a recent availability of wheelchairs which are effective for use in racing and sports activities. Some of these prior art constructions teach of a selective positioning of a rear wheel so as to alter the center of gravity of the wheelchair by selective positioning of the rear wheel. However, little attention has been paid to the front wheel assemblies, often referred to as "casters" or "front wheel casters" used on these wheelchairs. It has been found in connection with the present invention that the selective positioning of the front wheel can materially affect the overall steering and riding characteristics of the wheelchairs. This is particularly important in racing conditions and sports activities.

It has also been found that when using wheelchairs where the wheels are positioned so that the frame and particularly the seat portion is not horizontally disposed, the user's weight is not evenly distributed from front to rear of the wheelchair, as a result, there is a tendency for the wheelchair to drift, particularly immediately after movement. In other words, in stall conditions, the wheelchair may have a tendency to drift or move around.

It has also been found in connection with the prior art wheelchairs that they are not sufficiently stable when the user is attempting to enter or exit the wheelchair. This is also a problem when a user with a high level back injury is being assisted in entry or exit from the wheelchair.

U.S. Pat. No. 3,893,708 to Moroney discloses a wheel hub and bearing assembly for use with a wheelchair. This assembly is primarily adapted for use on the rear wheels of the wheelchair. Moreover, the construction is quite complex utilizing a plurality of bearing arrangements which thereby substantially increases the overall costs of such a bearing assembly.

U.S. Pat. No. 1,784,330 discloses a wheel retainer which is used with aircraft. This device is designed to prevent displacement of a wheel on the aircraft in the event that the wheel structure breaks and which is also adapted to permit removal of the wheel from the aircraft.

U.S. Pat. No. 4,231,670 to Knoski also discloses a wheel assembly for use with a motor vehicle such as aircraft. This patent discloses a snap/lock pin assembly for releasably mounting a wheel to a vehicle. In this particular case, the wheel may be removed from a heavier axle retaining hub.

OBJECTS OF THE INVENTION

It is a primary object of the present invention to provide a wheelchair having both rear wheels and front wheels and where the front wheels are capable of being shifted longitudinally and vertically in order to change the wheel base of the wheelchair, the angle of attack of the wheelchair, and the center of gravity thereof.

It is another object of the present invention to provide a wheelchair of the type stated in which the front wheels can be adjustably positioned, and in which a front wheel mounting means is capable of receiving different sized front wheels.

It is a further object of the present invention to provide a wheelchair construction which is highly effective for use in normal transport and in athletic activities by adjustably positioning the front wheels of the wheelchair.

It is still a further object of the present invention to provide a means for attaching a front wheel assembly to a wheelchair such that the main posts of the front wheel assemblies can be attached in a variety of angular positions to adjust the trailing angle of the front wheel.

It is also an object of the present invention to provide a quick release means for quickly releasing and reattaching the front wheels of a wheelchair.

It is yet another object of the present invention to provide a front wheel assembly where the front wheels can be temporatily locked for exit and entry of the user of the wheelchair.

With the above and other objects in view, my invention resides in the novel features of form, construction, arrangement and combination of parts presently described and pointed out in the claims.

SUMMARY OF THE DISCLOSURE

The present invention provides several unique front wheel assemblies for use on wheelchairs adapted for transport of persons having certain deformities or walking disabilities.

The wheelchairs usually are comprised of a main frame which may be a relatively rigid structure or the frame may be in the form of a foldable structure for purposes of folding the wheelchair for transport and storage. In each case, the wheelchair normally contains a seat structure for supporting the buttocks of the individual and a back rest structure for supporting the back of the individual. Furthermore, the wheelchairs may be provided with armrests or retainers on the sides of the wheelchair. In all cases, the wheelchairs usually contain a pair of enlarged rear wheels with hand rims thereon for propelling the wheelchair and front wheel assemblies often referred to as front wheel "casters".

The present invention provides unique front wheel assemblies and in addition, by using these front wheel assemblies on a wheelchair, a unique wheelchair construction is obtained. By using the front wheel assemblies of the present invention on these wheelchairs, it is possible to adjustably position the front wheels and thereby alter the angle of attack of the wheelchair relative to a ground plane. As used herein, the term "ground plane" refers to a ground surface or other supporting surface upon which the wheelchair would be used and is generally a horizontal surface. Further, the position of the front wheels can be altered relative to the rear wheels in order to change the wheel base. Thus, for example, the front wheels can be shifted closer to or further from the rear wheels to affect the position of the front wheels relative to the main frame in order to vary the riding or steering characteristics of the wheelchair.

A pair of rear wheel assemblies are provided in each wheelchair and each are adapted to be mounted on opposite sides of the wheelchair frame. Each assembly comprises a wheel post housing with a bracket for mounting on the main frame of the wheelchair. Thus, the wheelchair front wheel assemblies are constructed for easy replacement of conventional front wheel casters on existing wheelchairs.

A post extends outwardly of the wheel post housing. A separate yoke or so-called "fork" is carried by the post and is rotatable about a generally vertical axis relative to the associated wheel post housing. The yoke has a pair of spaced apart plates with a plurality of aligned apertures in said spaced apart plates. A separate wheel and axle is also provided and the front wheel axle is capable of being disposed in any of the plurality of aligned apertures. In this way, it is possible to adjust the plane of the frame, and hence, the angle of attack of the wheelchair relative to the ground plane.

In another embodiment of the invention, these front wheel yokes are sized so that different sized front wheels can be removably mounted to the yokes. A quick release means may also be associated with each of the front wheel assemblies. The quick release means utilizes the post extending outwardly from each of the wheel post housings. By simple push-button actuation it is thereby possible to release or reattach a front wheel to a wheelchair.

In another embodiment of the present invention, it is possible to selectively position the post which carries the front wheel in order to vary the trailing angle thereof. This is important, not only in affecting the riding characteristics, but also in that it affects the stall characteristics, that is, the position the wheelchair assumes immediately after stopping movement thereof.

The present invention also provides a front wheel assembly with a locking mechanism for temporarily locking the front wheels in a selected position. This is highly effective to permit exit and entry from the wheelchair, generally for all users. Further, it is desirable to temporarily lock the front wheels during occasions when the wheelchair will remain stationary for a substantial period of time and where the ground level may not be perfectly flat.

This invention possesses many other advantages and has other purposes, which may be made more clearly apparent from a consideration of the forms in which it may be embodied. These forms are shown in the drawings forming and accompanying part of the present specification. They will now be described in detail for the purposes of illustrating the general principles of the invention, but it is to be understood that such detailed descriptions are not to be taken in a limiting sense.

BRIEF DESCRIPTION OF THE DRAWINGS

Figure 1:
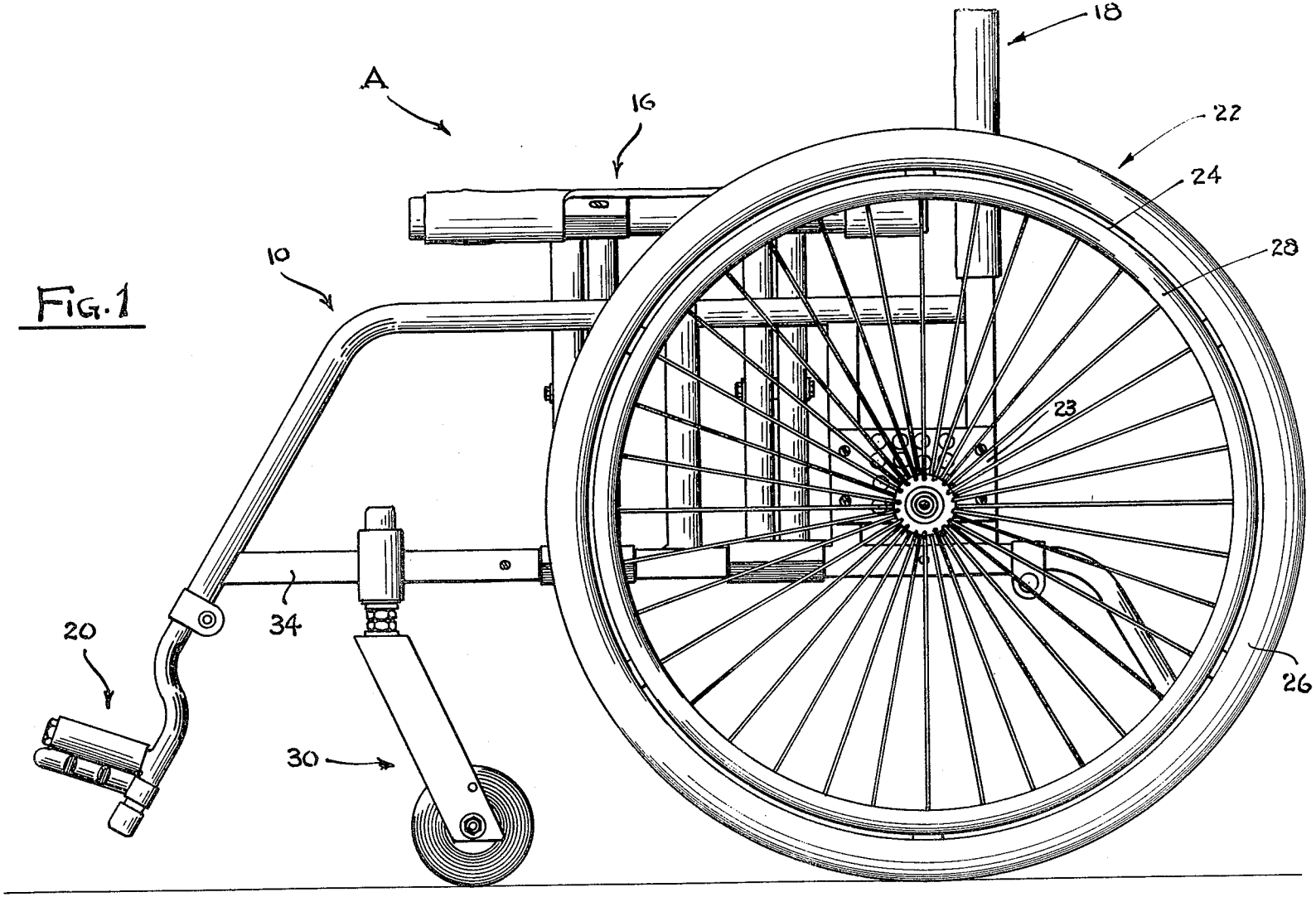
Figure 2:
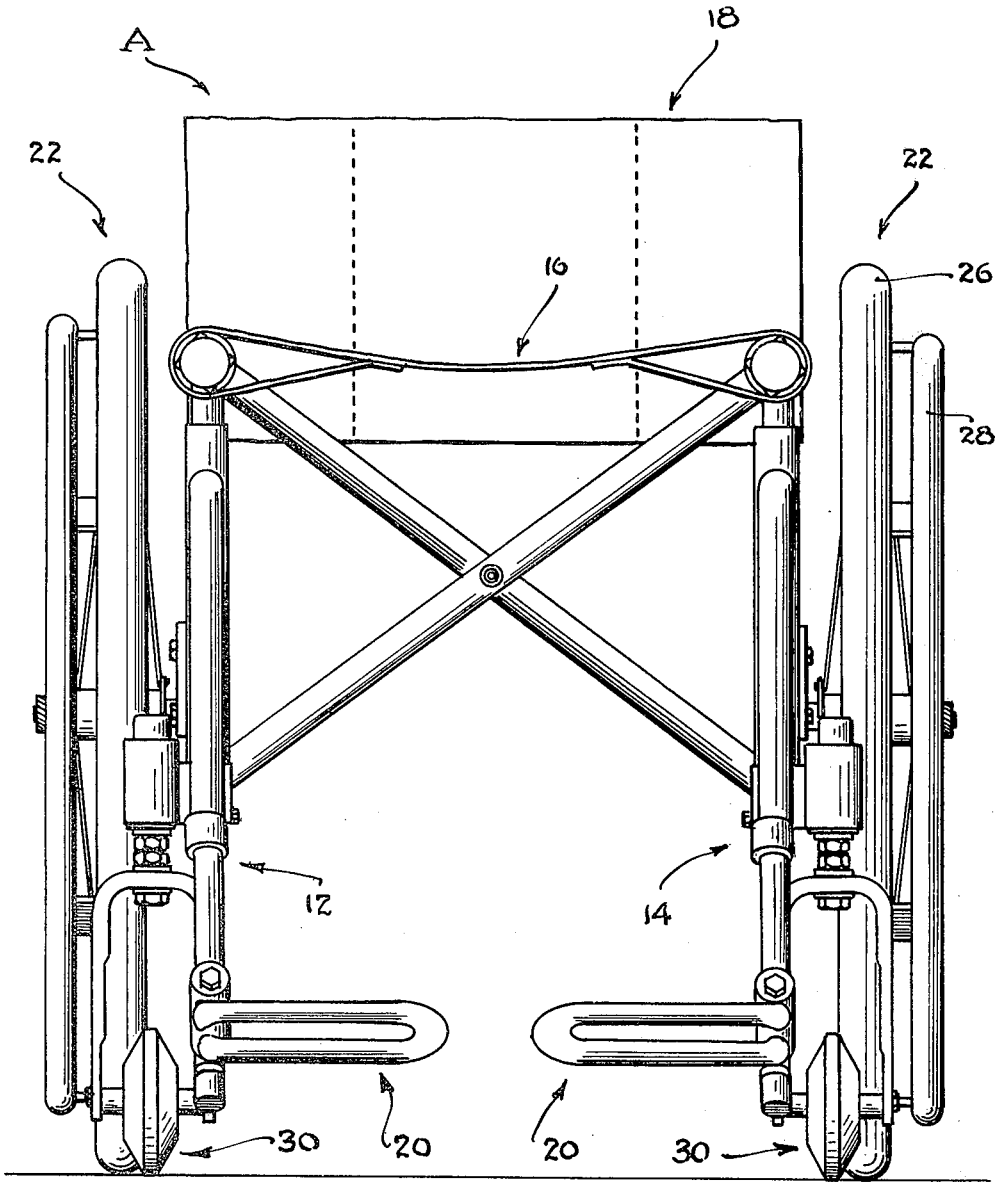
Figure 3:
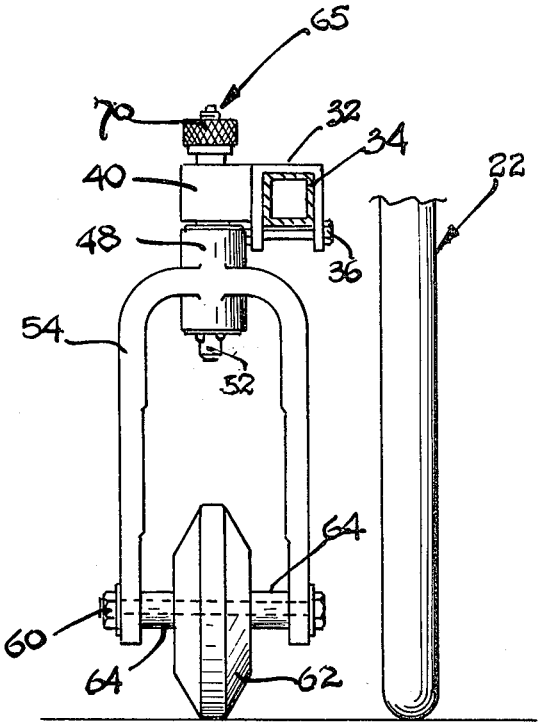
Figure 5:
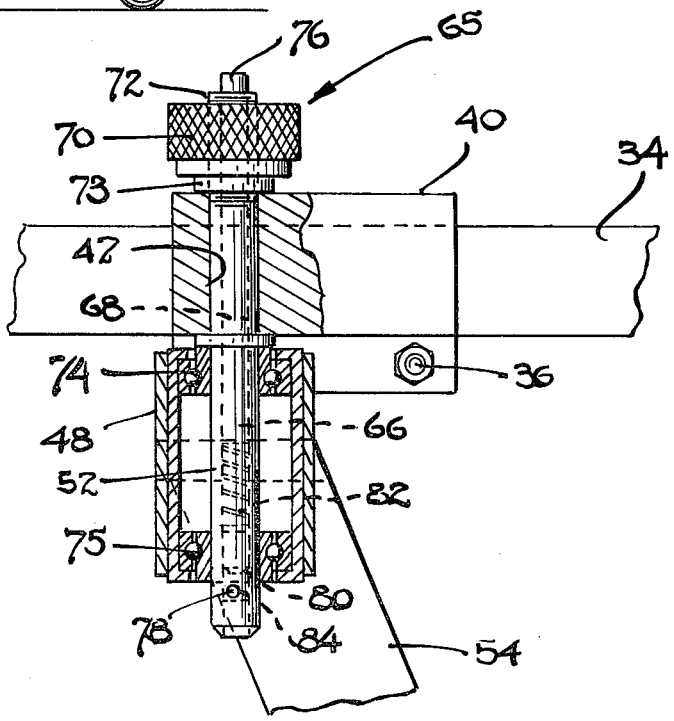
Figure 4:
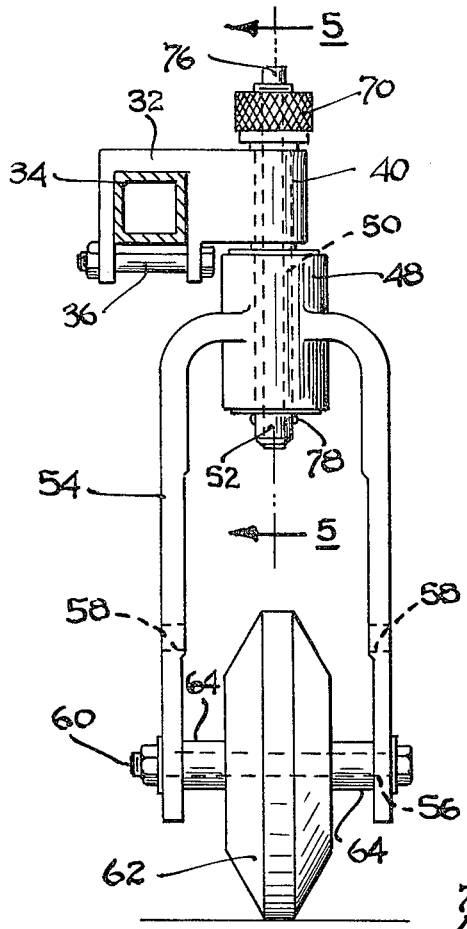
Figure 7:
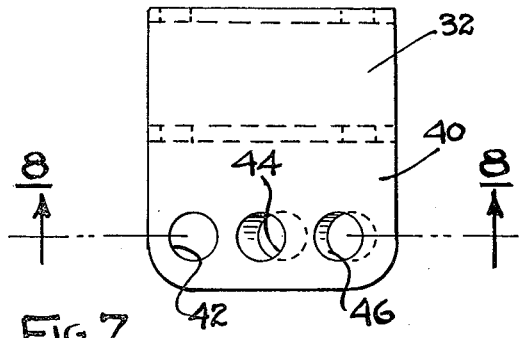
Figure 8:
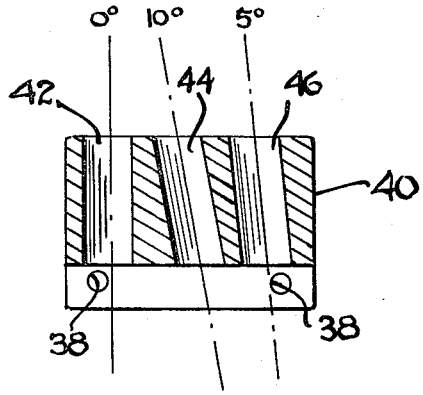
Figure 6:
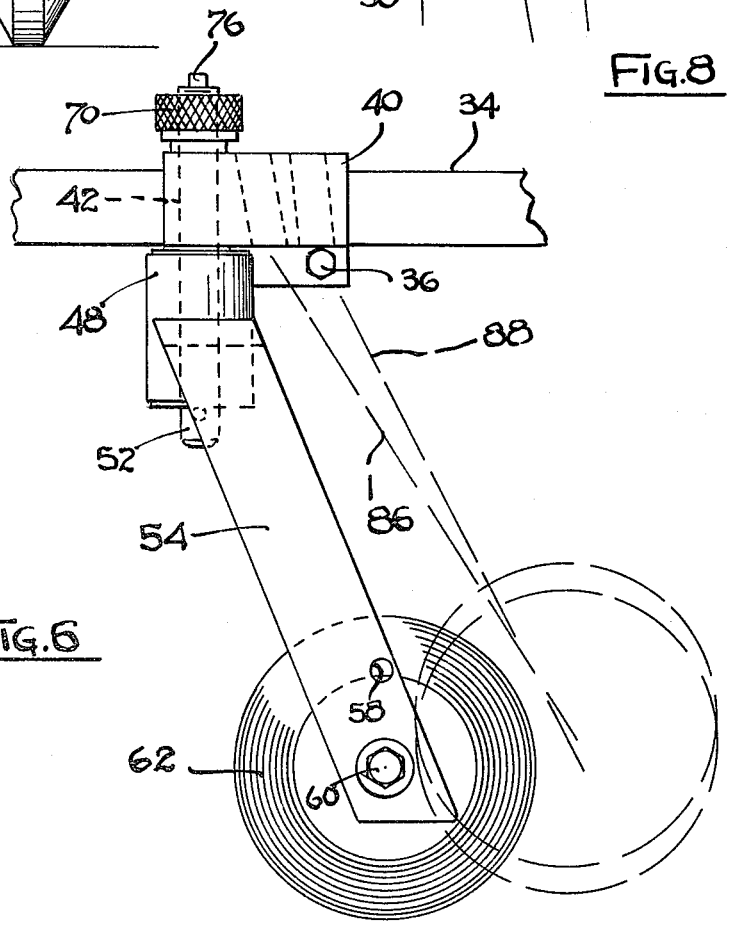
Figure 9:
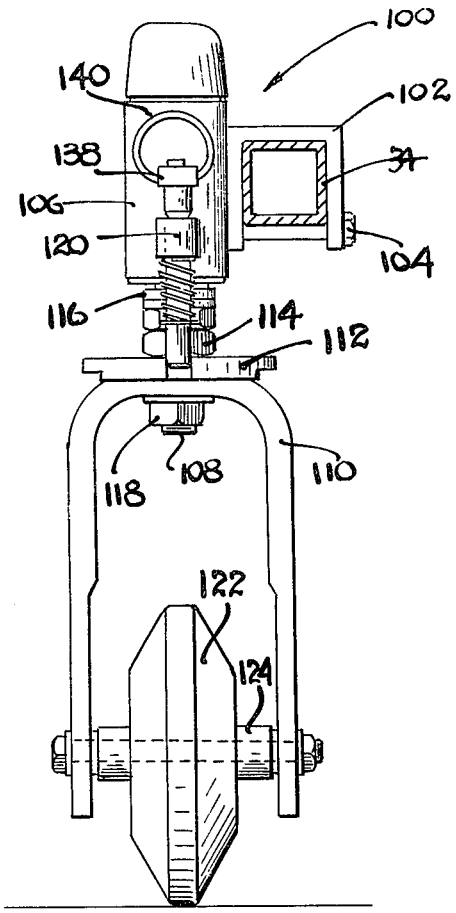
Figure 10:
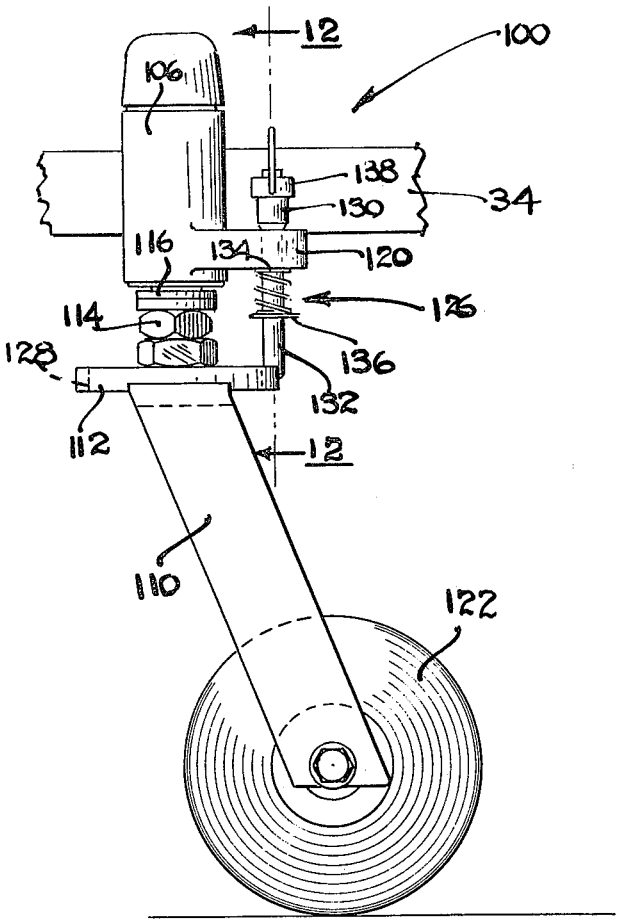
Figure 12:
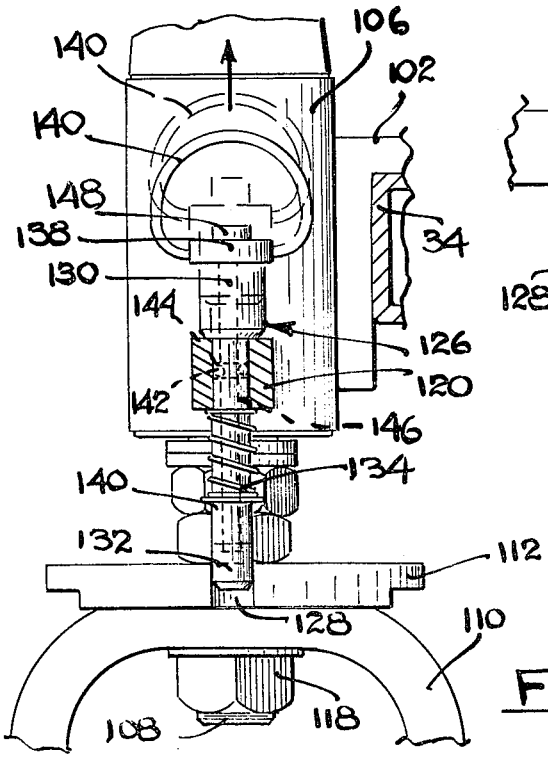
Figure 11:
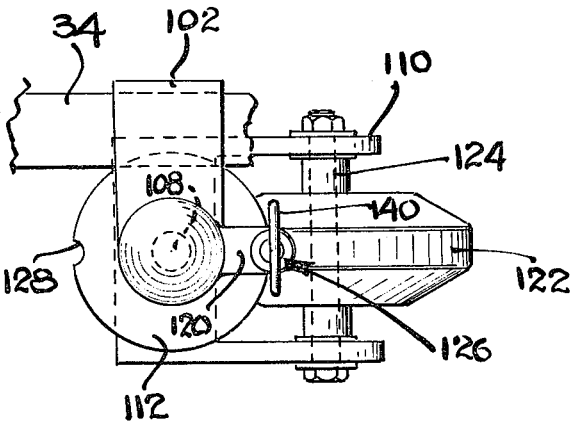

Having thus described the invention in general terms, reference will now be made to the accompanying drawings (four sheets) in which:

FIG. 1 is a side elevational view of a wheelchair using front wheel assemblies constructed in accordance with and embodying the present invention;

FIG. 2 is a front elevational view of the wheelchair of FIG. 1 using the front wheel assemblies of the present invention;

FIG. 3 is a fragmentary front elevational view showing a mounting of a front wheel to the main frame of the wheelchair in an alternate position compared to that of FIGS. 1 and 2;

FIG. 4 is an enlarged elevational view, of a front wheel assembly used on the wheelchair;

FIG. 5 is a vertical sectional view taken substantially along line 5—5 of FIG. 4 and showing a quick release means for releasably mounting a front wheel to an associated front wheel post housing;

FIG. 6 is a side elevational view of the front wheel assembly of FIGS. 4 and 5 and showing the mounting of front wheels in different positions to change to the angular position of the trailing edge of the front wheel;

FIG. 7 is a top plan view of a mounting bracket used in the front wheel mounting assembly of FIGS. 4–6 to permit change of the angular position of the trailing edge of the front wheel;

FIG. 8 is a sectional view taken along line 8—8 of FIG. 7;

FIG. 9 is a front elevational view of a modified form of front wheel assembly constructed in accordance with and embodying the present invention;

FIG. 10 is a side elevational view of the front wheel assembly of FIG. 9;

FIG. 11 is a fragmentary top plan view of the front wheel assembly of FIGS. 9 and 10; and FIG. 12 is an enlarged fragmentary vertical sectional view taken along line 12—12 of FIG. 10.

DETAILED DESCRIPTION OF PREFERRED EMBODIMENTS

Referring now in more detail and by reference characters to the drawings which illustrate practical embodiments of the present invention, A designates a wheelchair which utilizes the unique front wheel assemblies forming part of the present invention and which thereby provides a unique wheelchair construction, as well.

The wheelchair A which is more fully illustrated in FIGS. 1 and 2 generally includes a main frame 10 which, in this case, is a foldable wheelchair comprised of frame sections 12 and 14. However, the wheelchair main frame itself is not critical with respect to the front wheel assemblies and is therefore not described in any further detail herein. It should be understood that the front wheel assemblies can be used with and are useful with frames of the rigid type, and foldable frames of the type illustrated herein.

The wheelchair A is also provided with a seat structure 16 for supporting the buttocks and portions of the thighs of the user along with a back support 18 which generally supports the back of the user of the wheelchair. Further, foot supporting members 20 are also provided. In addition, many of these components may be adjustably mounted in order to accommodate different sized users.

The wheelchair A is also provided with a pair of rear wheels 22 on opposite sides of the wheelchair. It can be observed that these rear wheels may be adjustably mounted on brackets 23 in order to change the relative longitudinal and vertical position of the rear wheels. The mechanism for adjustably positioning the rear wheels is not critical to the subject matter of the present invention; although the adjustability of the rear wheels further enhances the wheelchair when provided with the front wheel assemblies of the present invention. Conventionally, the rear wheels of the wheelchair usually comprise a rim 24 having an inflatable tire 26 and may include a hand engagable ring 28 for engagement by the user to propel the wheelchair.

FIGS. 1 and 2 also illustrate the use of a pair of front wheel assemblies 30 constructed in accordance with and embodying the present invention. The front wheel assemblies are generally located at the forward portion of the wheelchair A, on each of the opposite sides thereof, e.g. on each of the frame sections 12 and 14. These front wheel assemblies 30 are more fully illustrated in FIGS. 4–12 of the drawings.

In one embodiment, the front wheel assembly 30 generally comprises an inverted generally U-shaped mounting bracket 32, as best seen in FIGS. 3 and 4. In this case, the bracket 32 is adapted to be disposed over a longitudinally extending lower frame bar 34 on each of the frame sections 12 and 14. Moreover, the mounting bracket 32 may be secured in a selected position along the longitudinally extending lower frame bar 34 by means of a bolt arrangement 36 which extends through the downwardly projecting legs of the bracket 32. Each of the legs of the bracket are provided with sets of aligned apertures 38 to receive the bolt arrangement 36. However, other means for retaining the bracket 32 may be provided.

Integrally formed with the bracket 32 is an enlarged block 40 and which extends horizontally outwardly therefrom. The block 40 is provided with a plurality of (three as shown) vertically disposed or somewhat vertically disposed apertures or bores 42, 44 and 46, for reasons which will presently more fully appear.

A cylindrically shaped mounting hub 48 is located beneath the enlarged block 40 and is provided with a central bore 50 which is capable of being aligned with any of the bores 42, 44 or 46. A generally vertically disposed mounting rod or axle 52 extends through one of the bores 42, 44 or 46 and through the central bore 50 in the hub 48 and is retained therein, in a manner to be hereinafter described in more detail. Integrally mounted on, or otherwise rigidly secured to, the hub 48 is a wheel supporting yoke 54 which is generally of an inverted U-shape, as also best seen in FIGS. 3 and 4 of the drawings. The wheel mounting yoke 54 is provided with a first pair of lower axle receiving apertures 56 and an upwardly located second pair of axle receiving apertures 58. In this case, each of the apertures in the respective pairs 56 and 58 are located on opposite sides of the wheel mounting yoke 54. A front wheel axle 60, which may be in the form of a bolt assembly, is mounted in the pairs of upper apertures 58 of the lower apertures 56, as shown, on each of opposite sides of the wheelchair. A wheel 62 may be disposed on the axle 60 and retained in position by means of spacer sleeves 64.

The second pair of apertures 58 which are located upwardly from the lower pair 56 are adapted to receive axles 60 and wheels 62 of larger diameter. In this way, the front wheels can be mounted in the upper apertures 58, such that a forward tilt is provided to the wheelchair. Otherwise, larger wheels could be so mounted. It should be understood that additional pairs of apertures could be provided in each of the wheel mounting yokes 54, as may be desired in order to further adjustably position the wheels, or to otherwise, provide for different diameter wheels.

By means of the above construction, it can be observed that the front wheels can be shifted closer to or further from the rear wheels in order to change the overall wheel base of the wheelchair. Further, the shifting of the front wheels relative to the rear wheels may also effect the angle of attack of the wheelchair, as hereinafter described in more detail. Thus, for example, if the rear wheels are changed in vertical position, the position of the front wheels relative to the rear wheels will affect the angle of attack.

By further reference to FIGS. 1–3 of the drawings, it can be observed that the front wheel assemblies 30 and hence the front wheels 62 can be reversed so as to be located either inwardly or outwardly of the main frame 10. FIGS. 1 and 2 illustrate the front wheels or so-called "casters" mounted exteriorly on the opposite longitudinal sides of the frame sections 22 and 24. By merely loosening the bolt arrangement 36 and removing the bracket 32 it is possible to switch the assemblies for use on opposite sides of the wheelchair frame, and to rotate each of the front wheel assemblies and then mount them on the interior of the lower frame bar 34, as illustrated in FIG. 3 of the drawings. This latter arrangement is preferred when the wheelchair is to be used in athletic activities in order to provide greater clearance, as for example, in bouncing a basketball, moving a tennis racket, or the like. In this way, the front wheels will not interfere with any moving object or a moving arm of the user of the wheelchair.

The front wheel posts 52 may also from part of a quick release lock mechanism 65 which is more fully illustrated in FIG. 5 of the drawings. The front wheel quick release lock mechanism 65 includes a pin 66 which is concentrically located within a centrally located axially extending bore 68 in the post 52.

A locking collar 70 having a knurled outer surface is also threadedly disposed on an upper threaded end 72 of the axle 52. A washer 73 is disposed about the post 52 between the collar 70 and the block 40, as best seen in FIGS. 4 and 5. Thus, by threadedly positioning the locking collar 70, it is possible to provide proper positioning and maintain the proper amount of tolerance e.g. axial degree of movement of the post 52 with respect to the hub 48. The post 52 is thus suitably retained within the hub 48 and fixed such that it does not rotate. The hub 48 is rotatable about the post 52 by means of upper and lower roller bearings 74 and 75.

The locking collar 70 is provided with an upwardly facing recess (not shown) which receives an upwardly extending end 76 of the release pin 66. This upwardly extending end 76 functions as a release button which is manually actuable to axially displace the pin 66 to thereby release a pair of locking elements, such as detent balls 78, at the lower end of the post 52. The release pin 66 is provided with an annular groove 80, such that when the pin 66 is pushed downwardly, the groove 80 becomes aligned with the detent balls 78 permitting the balls 78 to fall inwardly. This permits the post 52 to be pulled upwardly. However, when the release pin 66 is biased upwardly by means of a compression spring 82, the balls 78 are displaced by a shoulder 84 thereby biasing the balls outwardly. In this way, the balls 78 function as locking elements, as aforesaid. The detent balls 78 engage the underside of the hub 48 as illustrated to hold the post 52 in a position where the hub is locked thereto.

When it is desired to replace a front wheel assembly 30, the pin 66 can be pushed downwardly in the post 52, thereby permitting the locking elements 78 to be moved radially inwardly toward the center of the pin 66. This will permit the post 52 to be removed or shifted upwardly within the bore 50. When the post 52 is completely removed, the hub 48 and the yoke 54 can be removed and replaced with another hub and yoke having a different wheel and axle combination. In like manner, when it is desired to mount the front wheel on the wheelchair, the release pin 66 is pushed downwardly by manually engaging the upper end 76. Again, the locking elements 78 will be permitted to be moved radially inwardly, thereby permitting the post 52 to be reinserted through the hub 48.

As indicated previously, the post 52 can be inserted through any one of the bores 42, 44 or 46. In this respect, it is only necessary in some embodiments to employ one vertically disposed bore, such as the bore 42, in order to receive the post 52. The bore 42 is a truly vertically disposed bore. The bore 44, however, is angulated at an angle of about 10 degrees with respect to a true vertical axis and the bore 46 is angulated at an angle of about 5 degrees with respect to a true vertical, as more fully illustrated in FIGS. 7 and 8 of the drawings. Thus, by inserting the post 52 in either of the bores 44 or 46, it is possible to adjust the trailing angle of the wheel 62 relative to a ground plane. In other words, the U-shaped yoke 54 would be angulated as illustrated by the phantom lines in FIG. 6. This would also change the overall elevation of the front wheel 62.

When the retaining post 52 is inserted in the bore 42, the yoke 54 will assume the position as illustrated in the solid lines of FIG. 6. When the retaining rod 52 is inserted in the bore 44, the center line of the yoke will assume the position as illustrated by the phantom line designated by reference numeral 86 in FIG. 6. Finally, when the retaining rod 52 is inserted within the bore 46, the center line of the yoke 54 will assume the position as illustrated by the phantom line designated by reference numeral 88 in FIG. 6.

By this relatively simple and inexpensive arrangement, it is possible to materially change the angle of the trailing edge of the front wheels 62 and materially affect the riding characteristics and particularly the stall characteristics of the wheelchair. For example, depending upon the particular elevation of the front and rear wheels, there may be a tendency for the wheelchair to turn or to shift backwards or forwardly when it is immediately stalled after movement. Thus, this tendency can be overcome by slightly changing the angle of the trailing edge of the front wheel relative to a ground plane, as illustrated in FIG. 6.

It should be understood that additional bores with differing angles could also be provided in the block 32. Further, it is also possible to include bores at angles which are opposite to those illustrated in FIGS. 7 and 8 in order to affect the angle of the leading edge of the wheel with respect to a ground plane.

This ability to change the angle of the mounting or retaining post 52 also permits proper balancing of the chair when the elevation of the rear wheels is changed relative to the frame of the wheelchair. Thus, problems of the front portion of the wheelchair rising or falling slightly as the casters are turned 180 degrees about a vertical axis have been eliminated. By means of this construction the rear wheels can be positioned at essentially any of a number of desired locations without creating instability in the chair or user discomfort since the front wheels can be changed to accomodate positioning of the rear wheels.

FIGS. 9–12 of the drawings illustrate a further embodiment of the invention employing a front wheel assembly 100 and which is designed to temporarily lock the position of the front wheel, and to maintain the front wheel in a selected orientation with respect to the main frame of the wheelchair. In this embodiment of the invention, a generally inverted U-shaped mounting bracket 102 is provided for disposition over the lower frame bars 34 and may be retained on any such frame bar 34 by means of a bolt assembly 104. Mounted to one of the flat surfaces of the inverted U-shaped bracket 102 is a front wheel mounting hub 106.

The hub 106 is provided with a centrally located vertically extending mounting rod or post 108 which extends outwardly from the lower end thereof and carries an inverted generally U-shaped yoke 110 similar to the previously described yoke 54. This mounting post 108 also carries on the upper surface thereof a retaining plate 112 integrally formed therewith, in the manner as illustrated in FIGS. 9–12. A plurality of locking nuts 114 and washers 116 are disposed about the post 108 between the lower end of the hub 106 and the plate 112, in the manner as illustrated in FIGS. 9 and 10. Further, the retaining post 108 is held against the underside of the upper portion of the yoke 110 by means of a locking nut 118.

In this particular embodiment, the hub 106 is provided with an integrally formed outwardly extending lock mounting boss or projection 120, as more fully illustrated in FIGS. 9–11 of the drawings. The yoke 110 is similarly provided with a front wheel 122 and a front wheel axle 124 adapted to extend through aligned apertures formed in the separate legs of the yoke 110. While not illustrated, it should be understood that pairs of vertically spaced apart aligned apertures could be provided in the yoke 110 in order to receive the wheel 122 and axle 124 in such different positions and further in order to receive axles carrying different sized front wheels 122.

Retained by the outwardly extending boss 120 is a locking mechanism 126 which is adapted to cooperate with a pair of diametrially spaced apart notches 128 located in the plate 112, and particularly, on diametrically opposed peripheral portions thereof.

The locking mechanism 126 also comprises an enlarged hub 130 which is retained by and engaged by the upper surface of the boss 120, in the manner as illustrated in FIGS. 9, 10 and 12 of the drawings. The enlarged hub 130 carries a downwardly extending locking pin 132 which extends through the boss 120 into the plate 112, as more fully illustrated in FIGS. 9–12 of the drawings. Disposed about the locking pin 132 is a spring 134 which bears against the lower surface of the boss 120 and also is secured at its lower end by an enlarged ring section 136 located within a concentrically reduced section on the locking pin 132. Thus, the locking pin 132 is normally biased downwardly so that the lower end of the locking pin 132 is located in the notches 128, thereby preventing rotation of the front wheel assemblies. It should be observed that when the locking pin 132 is in the lowermost position, as illustrated in FIG. 12, it will extend within either of the diametrically opposed notches 128 and thereby lock the plate 112 and therefore the yoke 110 against rotation. When removed from the notches 128, it can be observed that the plate 112 and hence the yoke 110 as well as the front wheel 122 are permitted to rotate about the post 108.

The locking pin 132 is provided at its upper end with an enlarged head 138. A finger engaging ring 140 secured to the head 138 is sized and located to be engaged by a finger of a user to be pulled upwardly and thereby pull the locking pin 132 upwardly. A pair of locking elements, in the form of a pair of opposed detent balls 142 are located within an annular groove 144 in the locking pin 132 and are typically biased outwardly thereon by means of a concentric inner biasing pin 146 located within the locking pin 132, in the manner as previously described in connection with the mounting of the front and rear wheels.

When the locking elements are located outwardly and above the boss 120, they will thereby lock the locking pin 132 in the upper position where it is not capable of extending into the notches 128. However, upon pressing on the end of the pin 146, the locking elements 142 will be permitted to be biased inwardly, in the manner as previously described, thereby permitting the locking pin 132 to drop further within the boss and hence permitting the lower end thereof to drop within the notch 128. In this way, the yoke 110 and front wheel combination is prevented from rotating. When it is desired to release the lock, mere pulling up on the ring 136 will cause a pulling movement of the locking pin 132 and hence move the locking elements 142 to a position where they will move outwardly and above the boss 120. As this occurs, the locking elements 142 will be biased outwardly where they thereupon engage the upper surface of the boss 120 holding the pin 13 out of the locking engagement with notches 128.

This type of locking arrangement is highly effective for use on wheelchairs, particularly in the case of certain disabilities, such as those associated with lower back injuries. For example, in transporting or enabling a person to transport himself or herself from a position outwardly of the wheelchair to a seated position in the wheelchair, it is necessary to maintain complete stability of the wheelchair and prevent any undue rotation of the front wheels whatsoever. This locking mechanism is quite unique in that a positive locking action occurs merely by pushing downwardly on the locking pin 132. Conversely, an unlocking action, that is an action where the front wheels can rotate can be obtained merely by pulling upwardly on the ring 140 and hence on the locking pin 132. Consequently, this type of locking mechanism is capable of being managed and used by many handicapped and disabled persons.

Thus, there has been illustrated and described unique and novel front wheel assemblies which permit adjustability to alter moving and stall characteristics of wheelchairs in user transport or sports activities. These front wheel assemblies and wheelchairs using the same are capable of functioning for conventional movement as well as for athletic activities, and which therefore fulfills all of the objects and advantages therfore. It should be understood that many changes, modifications, variations, and other uses and applications will become apparent to those skilled in the art after considering this specification and accompanying drawings. Therefore, any and all such changes, modifications, variations, and other uses and applications which do not depart from the spirit and scope of the invention are demed to be covered by the invention which is limited only by the following claims.

Having thus described my invention, what I desire to claim and secure by Letters Patent is:

1. A front wheel assembly for selective positioning of a front wheel on a frame of a wheelchair, said front wheel assembly comprising:

(a) a wheel post housing, (b) mounting means attached to the wheel post housing for mounting the front wheel assembly to the frame of a wheelchair, (c) a post extending outwardly from said wheel post housing and being rotatable relative to said wheel post housing, (d) a wheel mounting yoke carried by said post and being rotatable about a generally vertical axis relative to the wheel post housing, and said yoke having a pair of spaced apart plates with at least one pair of aligned apertures in said spaced apart plates, (e) a wheel and axle combination and said axle capable of being disposed in the pair of aligned apertures, (f) a quick release means operatively associated with said yoke to quickly release the yoke and wheel and axle from the associated wheel post housing, said quick release means comprising a pushable element which automatically releases the post from the associated housing when pushed.

2. The front wheel assembly of claim 1 further characterized in that said plates of said yoke have a plurality of vertically spaced apart pairs of apertures to receive a front wheel axle to thereby affect the plane of the wheelchair frame and hence angle of attack of the wheelchair relative to a ground plane.

3. The front wheel assembly of claim 2 further characterized in that said yoke is sized so that different sized wheels can be removably mounted with respect to said yoke.

4. The front wheel assembly of claim 1 further characterized in that said mounting means is a bracket which extends from the wheel post housing and is adapted for attachment to said frame in a first position and a second position, the wheel post housing being located outwardly of the side of the frame when the mounting bracket is in the first position and being located inwardly of the side of the frame when the mounting bracket is in the second position, the steering radius and steering stability of the wheelchair being a function of the positions of front wheels on said wheelchair in either the first or second position.

5. The front wheel assembly of claim 1 further characterized in that said wheel post housing is adapted to be generally vertically located, and said post extends generally vertically downwardly and outwardly from the wheel post housing.

6. The front wheel assembly of claim 1 further characterized in that means is provided with said front wheel assembly so that the wheel post housing can be selectively angulated relative to a ground plane and thereby affect the trailing edge angle of a front wheel relative to a ground plane.

7. A front wheel assembly for selective positioning of a front wheel on a frame of a wheelchair, said front wheel assembly comprising:

(a) a wheel post housing, (b) mounting means attached to the wheel post housing for mounting the front wheel assembly to the frame of a wheelchair, (c) a post extending outwardly from said wheel post housing and being rotatable relative to said wheel post housing, (d) a yoke carried by said post and being rotatable about a generally vertical axis relative to the wheel post housing, said yoke having a means to mount a front wheel axle, (e) a wheel and axle combination for said yoke and said axle capable of being mounted with respect to said yoke, (f) a release means operatively on said front wheel assembly to release the front wheel and axle from the associated wheel post housing for replacement of a front wheel, and (g) adjustable retaining means for retaining the post in any of a plurality of selected angular position relative to a vertical axis and thereby selectively position the yoke relative to a ground plane.

8. The front wheel assembly of claim 7 further characterized in that said yoke comprises a pair of spaced apart plates with a pair of apertures to receive a front wheel axle.

9. The front wheel assembly of claim 7 further characterized in that said yoke comprises a pair of spaced apart plates having a plurality of vertically spaced apart pairs of apertures with each of the pairs of apertures adapted to receive a front wheel axle and thereby affect the plane of the wheelchair frame and hence the angle of attack of the wheelchair relative to a ground plane.

10. The front wheel assembly of claim 7 further characterized in that the release means is a quick release means which permits release of a yoke by pushing on a pushable element.

11. The front wheel assembly of claim 7 further characterized in that the adjustable retaining means is a block secured to said mounting means and having a plurality of bores with different angles relative to a vertical axis and each of which are adapted to removably receive the post.

12. The front wheel assembly of claim 11 further characterized in that said bores include a vertical bore, a bore at 5 degrees from the vertical and a bore at 10 degrees from the vertical.

13. The front wheel assembly of claim 7 further characterized in that said mounting means is a bracket which extends from the wheel post housing and is adapted for attachment to said frame in a first position and a second position, the wheel post housing being located outwardly of the side of the frame when the mounting bracket is in the first position and being located inwardly of the side of the frame when the mounting bracket is in the second position, the steering radius and steering stability of a wheelchair being a function of the positions of front wheels on said wheelchairs in either the first or second position.

14. The front wheel assembly of claim 13 further characterized in that said yoke is sized so that different sized wheels can be removably mounted with respect to said yoke.

15. The front wheel assembly of claim 14 further characterized in that said yoke comprises a pair of spaced apart plates with pairs of aligned apertures vertically located on said spaced apart plates to receive different sized front wheels.

16. An apparatus for selectively positioning the front wheels of a wheelchair having a frame means to selectively alter the angle of attack of the wheelchair relative to a ground plane and to selectively alter the steering characteristics of the wheelchair, said apparatus comprising:

(a) a separate mounting member for securement to each of the opposite sides of the frame means of the wheelchair, (b) receiving means associated with each of the mounting members for receiving a wheel post in any of a plurality of angular positions relative to the ground or other supporting surface, (c) a separate wheel supporting post adapted for connection to said receiving means, (d) a separate yoke carried by each of said posts and being rotatable about a generally vertical axis relative to the associated wheel post housing, and each of said yokes having a pair of spaced apart plates with a pair of aligned apertures in said spaced apart plates, and (e) a separate wheel and axle for each said yoke and each axle capable of being disposed in the aligned apertures, and where the angle of the wheel post relative to the frame means can be adjusted to affect steering and riding characteristics.

17. The apparatus of claim 16 further characterized in that each post extends from a wheel post housing which permits rotation of the associated wheel post.

18. The apparatus of claim 17 further characterized in that each of said yokes have a plurality of pairs of spaced apart aligned apertures to receive the axles of the wheel assemblies to thereby permit adjustment of the plane of the frame means of the wheelchair and the angle of attack of the wheelchair relative to a ground plane.

19. The apparatus of claim 16 further characterized in that a quick release means is operatively associated with each of said yokes to quickly release each said yoke and front wheel and axle assembly from the wheelchair frame, said quick release means comprising a pushable element which automatically releases the posts from the housings when pushed.

20. A wheelchair comprising:

(a) a main frame, (b) a pair of wheel post housings on said frame, (c) a post extending outwardly from each of said wheel post housing and being rotatable relative to said wheel post housings, (d) a separate yoke carried by each of said posts and being rotatable about a generally vertical axis relative to the associated wheel post housing, and each of said yokes having a pair of spaced apart plates with a plurality of pairs of aligned apertures in said spaced apart plates, (e) a separate wheel and axle for each said yoke and each axle capable of being disposed in any of the plurality of pairs of aligned apertures to thereby adjust the plane of the frame and hence the angle of attack of the wheelchair relative to a ground plane, and (f) a quick release means operatively associated with each of said yokes to quickly release the wheel post and yoke and wheel and axle from the associated wheel post housing, said quick release means comprising a pushable element which automatically releases the post from the associated housing when pushed.

21. The wheelchair of claim 20 further characterized in that a mounting member extends from each of the wheel posts housings and is adapted for attachment to said frame means in a first position and a second position, the wheel post housings being located outwardly of the sides of the frame when the associated mounting members are in the first position and being located inwardly of the sides of the frame when the associated mounting members are in the second position, the steering radius and steering stability of a wheelchair being a function of the positions of front wheels in either the first or second position.

22. The wheelchair of claim 21 further characterized in that said yokes are sized so that different sized wheels can be removably mounted with respect to each of said brackets.

23. The wheelchair of claim 20 further characterized in that said wheel post housings are generally vertically located, and said posts extend downwardly and outwardly from the associated wheel post housing.

24. The wheelchair of claim 23 further characterized in that said pair of aligned apertures are vertically located on said spaced apart plates.

25. A wheelchair comprising:

(a) a main frame, (b) rear wheels mounted on said main frame, (c) a separate mounting member for securement to each of the opposite sides of the main frame of the wheelchair, (d) receiving means associated with each of the mounting members for receiving a wheel post in a plurality of angular positions relative to the ground or other supporting surface, (e) a separate wheel supporting post adapted for connection to each of said receiving means, (f) a separate yoke carried by each of said posts and being rotatable about a generally vertical axis relative to the associated wheel post housing, and of said yokes having a pair of spaced apart plates with a pair of aligned apertures in said spaced apart plates, and (g) a separate wheel and axle for each said yoke and each axle capable of being disposed in the aligned apertures, and where the angle of the wheel post relative to the main frame can be adjusted to affect steering and riding characteristics.

26. The wheelchair of claim 25 further characterized in that each post extends from a wheel post housing which permits rotation of the associated wheel post.

27.

The wheelchair of claim 26 further characterized in that a quick release means is operatively associated with each said yoke to quickly release the wheel post and yoke and wheel and axle from the associated wheel post housing, said quick release means comprising a pushable element which automatically releases the post from the associated housing when pushed.

28. The wheelchair of claim 25 further characterized in that the receiving means has a plurality of openings adapted to receive the wheel posts and certain of said openings are located at different angular positions relative to a horizontal plane.

29. The wheelchair of claim 25 further characterized in that each of said yokes have a plurality of pairs of spaced apart aligned apertures to receive the axles of the wheel assemblies to thereby permit adjustment of the plane of the frame means of the wheelchair and the angle of attack of the wheelchair relative to a ground plane.

30. A wheel assembly for use with wheelchairs, said wheel assembly comprising:

(a) a wheel post housing, (b) mounting means for mounting the wheel post housing to a frame of a wheelchair, (c) a yoke operatively coupled to said wheel post housing for rotation about a generally vertical axis, (d) a wheel and axle arrangement carried by said yoke, (e) a locking device operatively mounted on said assembly and having a locking pin capable of being engagable with a notch associated with said yoke and preventing rotation of said yoke when said locking pin is in said notch, (f) an engagable portion on said locking pin for engagement by a user to manually move said pin to the position where it is engagable with said notch, (g) a locking element associated with said pin to hold same in a locked position, and (h) release means operatively associated with said locking element and being manually operable to prevent said locking element from holding the pin in the locking position.

31. The wheel assembly of claim 30 further characterized in that said locking device is mounted on a flange extending from said housing, said pin extends through said flange and is biased into engagement with said notch by a spring means.

32. The wheel assembly of claim 31 further characterized that locking elements project outwardly from said pin and engages the underside of a member which carries said notch when in the locked position, said locking elements are capable of being moved inwardly and permit removal of said locking pin upon actuation of a manually actuable member.

33. The wheel assembly of claim 30 further characterized in that a spring means normally biases said pin to a position where it is not in engagement with said notch, and said release means permits the spring means to bias the pin out of engagement with the notch when actuated.

34. The wheel assembly of claim 30 further characterized in that a wheel post extends outwardly from said housing and carries said yoke and permits said yoke to be rotatable about a generally vertical axis.

35. The wheel assembly of claim 34 further characterized in that said wheel post housing is generally vertically located, and said post extends downwardly and outwardly from the associated wheel post housing.

36. The wheel assembly of claim 35 further characterized in that quick release means is operatively associated with said wheel post for quickly releasing the yoke and axle and wheel.

37. The wheel assembly of claim 30 further characterized in that said yoke is sized so that different sized wheels can be removably mounted with respect to said yoke.

38. A front wheel assembly for selective positioning of the front wheels on a frame of a wheelchair, said front wheel assembly comprising:

(a) a wheel post housing, (b) mounting means attached to the wheel post housing for mounting the front wheel assembly to the frame of a wheelchair, (c) a wheel mounting assembly having a wheel post extending outwardly from said wheel post housing and being rotatable relative to said wheel post housing, (d) a front wheel for attachment to said post, (e) a wheel mounting means associated with said post for operatively mounting said front wheel with respect to said post so that said front wheel is rotatable about a generally horizontal axis during movement of the wheelchair and is also rotatable about a generally vertical axis relative to the wheel post housing, and (f) a quick release means operatively associated with said wheel mounting means to quickly release the front wheel and post from the associated wheel post housing, said post forming part of said quick release means, said quick release means also comprising a pushable element associated with said post which automatically releases the post from the associated housing when pushed.

39. A wheel assembly for selective positioning of a wheel on a frame of a wheelchair, said wheel assembly comprising:

(a) a wheel post housing, (b) mounting means attached to the wheel post housing for mounting the wheel assembly to the frame of a wheelchair, (c) a post extending outwardly from said wheel post housing and being rotatable relative to said wheel post housing, (d) a wheel mounting yoke carried by said post and being rotatable about a generally vertical axis relative to the wheel post housing, and said yoke having a pair of spaced apart plates, (e) a wheel and axle combination and said axle capable of being retained by the spaced apart plates of said yoke, (f) a quick release means operatively associated with said yoke to quickly release the yoke and wheel and axle from the associated wheel post housing, said quick release means comprising a pushable element which automatically releases the post from the associated housing when pushed.

40. A wheel assembly for selective positioning of a wheel on a frame of a wheelchair, said wheel assembly comprising:

(a) a wheel post housing, (b) mounting means attached to the wheel post housing for mounting the wheel assembly to the frame of a wheelchair, (c) a post extending outwardly from said wheel post housing and being rotatable relative to said wheel post housing, (d) a yoke carried by said post and being rotatable about a generally vertical axis relative to the wheel post housing, said yoke having a means to mount a wheel axle, (e) a wheel and axle combination for said yoke and said axle capable of being mounted with respect to said yoke, (f) a release means on said wheel assembly to release the wheel and axle from the associated wheel post housing for replacement of a front wheel, and (g) adjustable retaining means for retaining the post in any of a plurality of selected angular position relative to a vertical axis and thereby selectively positioning the yoke relative to a ground plane.

41. An apparatus for selectively positioning the front wheels of a wheelchair having a frame means to selectively alter the angle of attack of the wheelchair relative to a ground plane and to selectively alter the steering characteristics of the wheelchair, said apparatus comprising:

(a) a separate mounting means for securement to each of the opposite sides of the frame means of the wheelchair, (b) receiving means associated with each of the mounting means for receiving a wheel post in a plurality of angular positions relative to the ground or other supporting surface, (c) a separate wheel supporting post adapted for connection to said receiving means, (d) a separate front wheel for operative attachment to each wheel supporting post, and (e) a separate front wheel mounting means operatively associated with each of said posts for operatively mounting each front wheel with respect to an associated post so that the front wheels are rotatable about a generally horizontal axis during movement of a wheelchair and are also rotatable about a generally vertical axis relative to the associated wheel post housing, and where the angle of the wheel post relative to the frame means can be adjusted to affect steering and riding characteristics.

42. An apparatus for selectively positioning the wheels of a wheelchair having a frame means to selectively alter the riding characteristics and to selectively alter the steering characteristics of the wheelchair, said apparatus comprising:

(a) a separate mounting member for securement to each of the opposite sides of the frame means of the wheelchair, (b) receiving means associated with each of the mounting members for receiving a wheel post in a plurality of angular positions relative to the ground or other supporting surface, (c) a separate wheel supporting post adapted for connection to said receiving means, (d) a separate yoke carried by each of said posts and being rotatable about a generally vertical axis relative to the associated wheel post housing, (e) a separate wheel and axle for operative attachment to each said yoke, and where the angle of the wheel post relative to the frame means can be adjusted to affect steering and riding characteristics.

43. A front wheel assembly for use with wheelchairs, said front wheel assembly comprising:

(a) a wheel post housing, (b) mounting means for mounting the wheel post housing to a frame of a wheelchair, (c) a yoke operatively coupled to said wheel post housing for rotation about a generally vertical axis, (d) a wheel and axle arrangement carried by said yoke, (e) a mounting flange extending from said wheel post housing, (f) a member operatively associated with said yoke and having a notch therein, (g) a locking device operatively mounted on said assembly and having a locking pin extending through said flange and capable of being engagable with said notch and preventing rotation of said yoke when said locking pin is in said notch, (h) a spring means biasing said pin into engagement with said notch, and (i) locking elements projecting outwardly from said pin and engaging the underside of said member which has said notch when said locking pin is in a locked position, said locking elements capable of being moved inwardly to permit removal of said locking pin upon actuation of a manually moveable element.

44. The front wheel assembly of claim 43 further characterized in that a restraining element projects outwardly from said pin and engages said flange to hold said pin out of said notch, said restraining elements capable of being moved inwardly to permit the locking pin to be biased into engagement with said notch when said locking pin is moved to a position where said elements can engage said flange.

45. A front wheel assembly for use with wheelchairs, said front wheel assembly comprising:

(a) a wheel post housing;

(b) a generally vertically located wheel post extending downwardly and outwardly from said wheel post housing, (c) mounting means for mounting the wheel post housing to a frame of a wheelchair, (d) a yoke operatively carried by said wheel post for rotation about a generally vertical axis, (e) a wheel and axle arrangement carried by said yoke, (f) a member operatively associated with said yoke and having a notch therein, (g) a locking device operatively mounted on said assembly and having a locking pin capable of being engageable with a notch and preventing rotation of said yoke when said locking pin is in said notch, and (h) quick release means operatively associated with said wheel post for quickly releasing the yoke and axle and front wheel.

* * * * *